US005206128A

United States Patent [19]

Arai

[11] Patent Number: 5,206,128

[45] Date of Patent: Apr. 27, 1993

[54] SILVER HALIDE PHOTOGRAPHIC MATERIAL

[75] Inventor: Naoki Arai, Kanagawa, Japan

[73] Assignee: Fuji Photo Film Co., Ltd., Kanagawa, Japan

[21] Appl. No.: 725,115

[22] Filed: Jul. 3, 1991

[30] Foreign Application Priority Data

Jul. 4, 1990 [JP] Japan ..... 2-176825

[51] Int. Cl.[5] ..... G03C 1/76

[52] U.S. Cl. ..... 430/539; 430/523; 430/961

[58] Field of Search ..... 430/539, 525, 950, 961

[56] References Cited

U.S. PATENT DOCUMENTS 4,357,418 11/1982 Cellone ..... 430/539
4,369,245 6/1983 Beruto et al. ..... 430/539
4,399,213 8/1983 Watanabe et al. ..... 430/539
4,450,230 5/1984 Delfino et al. ..... 430/539
4,455,365 6/1984 Urata et al. ..... 430/539
4,460,580 7/1984 Ogawa et al. ..... 430/639
4,476,218 10/1984 Ogawa et al. ..... 430/539
4,513,080 4/1985 Helling ..... 430/539
4,840,881 6/1989 Watanabe et al. ..... 430/539
4,944,966 7/1990 Jerenz ..... 430/539

*Primary Examiner*—Jack P. Brammer
*Attorney, Agent, or Firm*—Sughrue, Mion, Zinn, Macpeak & Seas

[57] ABSTRACT

A silver halide photographic material is described including a support having thereon an emulsion layer and a protective layer in this order, wherein gelatin is contained in the protective layer in an amount of at least 1.5 $g/m^2$, gelatin is contained in the emulsion layer in an amount of at least 1.0 $g/m^2$, and the the coated amount of gelatin in the protective layer and the emulsion layer is a total of at most 3.5 $g/m^2$.

4 Claims, No Drawings

SILVER HALIDE PHOTOGRAPHIC MATERIAL

FIELD OF THE INVENTION

The present invention relates to a silver halide photographic material which can be processed by an ultrahigh speed automatic developing machine in a satisfactory manner. More particularly, the present invention relates to a silver halide photographic material which does not experience significant pinholing developed when the emulsion layer side of the silver halide photographic material is caught by small protrusions formed on the roller in the automatic developing machine during processing (hereinafter referred to as "scratch pinholing").

BACKGROUND OF THE INVENTION

A light-sensitive material adapted for processing at an ultrahigh speed is subject to pinholing developed when the emulsion layer side of the light-sensitive material is caught by small protrusions formed on the surface of the roller in an automatic developing machine during processing.

SUMMARY OF THE INVENTION

It is therefore an object of the present invention to provide a silver halide photographic material which is not susceptible to scratch pinholing, roller marking and underdrying, which can be easily developed in an ultrahigh speed automatic developing machine.

The above and other objects of the present invention will become more apparent from the following detailed description and examples.

The above object of the present invention is accomplished with a silver halide photographic material comprising a support having thereon at least one protective layer and at least one emulsion layer, wherein gelatin is contained in the protective layer in an amount of at least 1.5 g/m$^2$, gelatin is contained in the emulsion layer in an amount of at least 1.0 g/m$^2$, and the coated amount of gelatin in the protective layer and the emulsion layer is at most 3.5 g/m$^2$ in total.

DETAILED DESCRIPTION OF THE INVENTION

The present invention is characterized by the distribution of the coated amount of gelatin. In particular, scratch pinholing, roller marking and the like are normally avoided by improving the gelatin film strength of the silver halide emulsion layer. To this end, the proportion of gelatin content to silver halide content in the emulsion, i.e., the coated amount of gelatin in the emulsion layer, is normally increased.

On the other hand, in order to provide a silver halide photographic material with adaptability to processing at an ultrahigh speed, the coated amount of gelatin is generally reduced uniformly in all gelatin-containing layers of the photographic material.

The present inventions have found that better adaptability to processing at an ultrahigh speed can be obtained by providing a particular distribution of the coated amount of gelatin between a protective layer and an emulsion layer, rather than by uniformly reducing the coated amount of gelatin in the protective layer and the emulsion layer as before.

In accordance with the present invention, the development of scratch pinholing and roller marking on a silver halide photographic material can be inhibited and the dryability of the light-sensitive material can be improved in spite of a relatively small coated amount of gelatin in the emulsion layer by reducing the total coated amount of gelatin in the emulsion layer and the protective layer to 3.5 g/m$^2$ or less and increasing the coated amount of gelatin in the protective layer to 1.5 g/m$^2$ or more.

In the present invention, the silver halide emulsion layer may consist of two or more layers, and the protective layer includes all layers provided on the emulsion layer(s) (in the side further from the support) to protect the emulsion layer(s), such as a surface protective layer (outermost layer), a filter layer, an interlayer, an antihalation layer and the like.

The silver halide emulsion to the used in the present invention may be either monodisperse or polydisperse. The crystal form of the silver halide grains may be potato-like, sphericical or tabular. The silver halide emulsion may be a mixture of a plurality of emulsions with different properties. The emulsion grains may be coarse grains, fine grains, or mixture thereof.

The light-sensitive silver halide to be used in the present invention may be any of silver bromide, silver bromoiodide, silver chloride, silver bromochloride, silver chloroiodide and silver bromochloroiodide.

The crystalline structure of the silver halide may be such that the composition is homogenous from the shell to the core or such that the shell and the core differ from each other in composition to form a heterogeneous layered structure, or it may be of the conversion type as described in British Patent 635,841 and U.S. Patent 3,622,318.

In order to control the growth of grains during the formation of silver halide grains, silver halide solvents can be used, including ammonia, potassium thiocyanate, ammonium thiocyanate, thioether compounds as described in U.S. Pat. Nos. 3,271,157, 3,574,628, 3,704,130, 4,297,439, and 4,276,374, thione compounds as described in JP-A-53-144319, JP-A-53-82408, and JP-A-55-77737 (the term "JP-A" as used herein means an "unexamined published Japanese patent application"), amine compounds as described in JP-A-54-100717, and the like. Besides these silver halide solvents, a compound which controls the crystal habit by being adsorbed to the surface of grains, such as a cyanine dye, a tetraazaindene compound, or a mercapto compound, can be used during the formation of grains.

The emulsion to be used in the present invention may be either a negative type emulsion or a positive type emulsion (internal latent image type or previously fogged type).

After unnecessary salts have been removed by a flocculation process, the emulsion may then be subjected to a preparation process well known in the art to obtain a negative type or positive type emulsion. The size of the silver halide grains to be used in the present invention and the coated amount of silver are not specifically limited. In general, an emulsion of silver halide grains with a size of 0.45 μm or less may be preferably coated in an amount of less than 3 g/m$^2$, as calculated in terms of silver.

The emulsion layer or other hydrophilic colloidal layers in the photographic material prepared according to the present invention may comprise various surface active agents for the purposes of facilitating coating, inhibiting charging or adhesion, and improving smoothness or photographic properties (e.g., acceleration of development, improvement of contrast, sensitization). Preferred examples of such compounds include polyalkylene oxides having a molecular weight of 600 or more as described in JP-B-58-9412 (the term "JP-B" as used herein means an "examined Japanese patent publication").

The photographic emulsion of the present invention may comprise a dispersion of a water-insoluble or sparingly soluble synthetic polymer for the purpose of improving dimensional stability. For example, alkyl (meth)acrylate, alkoxyalkyl (meth)acrylate, (meth)acrylamide, vinyl ester (e.g., vinyl acetate), acrylonitrile, and the like can be used, singly or in combination.

The emulsion to be used in the present invention may advantageously comprise as a protective colloid mainly gelatin, particularly inert gelatin. Besides gelatin, photographically inert gelatin derivatives (e.g., phthalated gelatin), and water-soluble synthetic polymers (e.g., polyvinyl acrylate, polyvinyl alcohol, polyvinyl pyrrolidone, dextran, polyacrylamide) can be used generally in an amount of 5 to 50 wt % based on the weight of gelatin. In particular, dextran and/or polyacrylamide can be used in combination with gelatin.

Plasticizers can also be added to the emulsion generally in an amount of 2 to 20 wt % based on the weight of the protective colloid in the emulsion, and polyols such as trimethylol propane, pentanediol, butanediol, ethylene glycol, and glycerin can be used for the purpose.

The material of the present invention may comprise any proper photographic support, such as glass or a film base (e.g., cellulose acetate, cellulose acetate butyrate, polyester (e.g. polyethylene terephthalate)). Preferably, the support is colored blue.

The surface of the support is preferably subjected to corona discharge treatment, glow discharge treatment, or ultraviolet-light irradiation treatment to improve the adhesion to the hydrophilic colloidal layer.

Alternatively, a subbing layer comprising a styrene-butadiene latex, vinylidene chloride latex, or the like may be provided on the support. A gelatin layer may be further provided on the subbing layer. As another alternative, a subbing layer comprising an organic solvent containing a polyethylene swelling agent and gelatin may be provided on the support.

These subbing layers may be further subjected to surface treatment to improve the adhesion to the hydrophilic colloidal layer.

The silver halide photographic material of the present invention can contain a developing agent such as hydroquinone, catechol, aminophenol, 3-pyrazolidone, ascorbic acid and derivatives thereof, reductone, and phenylenediamine. A combination of these developing agents can be used. The developing agent can be incorporated in the silver halide emulsion layer and/or other photographic layers (e.g., surface protective layer, interlayer, filter layer, antihalation layer, back layer). The developing agent can be incorporated in these layers in the form of solution in a suitable solvent or a dispersion as described in U.S. Pat. No. 2,592,368, and French Patent 1,505,778.

In the present invention, finely divided grains of organic compounds such as polymethyl methacrylate as described in U.S. Pat. Nos. 2,992,101, 2,701,245, 4,142,894, and 4,396,706, a polymer of methyl methacrylate with methacrylic acid and starch, or inorganic compounds such as silica, titanium dioxide, strontium sulfate and barium sulfate can be added as matting agents in the protective layer (e.g., a surface protective layer). The amount of the matting agent is generally from 2 to 20 wt % based on the protective colloide in the protective layer. The grain size is preferably in the range of 1.0 to 10 μm, particularly 2 to 5 μm. In particular, a matting agent having a size of 0.3 to 1.3 μm may be preferably used in an amount of 70 to 250 mg/m$^2$.

A surface protective layer in the photographic light-sensitive material of the present invention may comprise as lubricant a silicone compound as described in U.S. Pat. Nos. 3,489,576 and 4,047,958 or colloidal silica as described in JP-B-56-23139. Besides these lubricants, parrafin wax, a higher aliphatic ester, and a starch derivative may be used.

The photographic processing of the photographic material prepared according to the present invention can be accomplished by any known method. As the processing solution, any known processing solution can be used. The processing temperature is normally between 18° C. and 50° C. Depending on the purpose, either development in which a silver image is formed (black-and-white photographic processing) or color photographic processing consisting of development in which a dye image is formed can be used. In particular, development can be accomplished by the method as described in *Research Disclosure* No. 17643, Vol. 176 (pp. 28–29) and No. 18716, Vol. 187 (from the left column to the right column on page 651).

In the ultrahigh speed processing of the present invention, the emulsion layer and/or other hydrophilic colloidal layers may preferably comprise an organic substance which can be eluted during development. If the substance to be eluted is gelatin, it is preferably a gelatin seed which does not take part in the crosslinking reaction of gelatin with a film hardener, such as acetylated gelatin and phthalated gelatin. Such a gelatin seed preferably has a small molecular weight. On the other hand, polyacrylamide as described in U.S. Pat. No. 3,271,158 and hydrophilic polymers such as polyvinyl alcohol and polyvinyl pyrrolidone can effectively be used as high molecular weight compounds other than gelatin. Saccharides such as dextran, saccharose and pullulan can also be effectively used. Preferred among these compounds are polyacrylamide and dextran. Particularly preferred among these compounds is polyacrylamide. These organic substances each preferably has an average molecular weight of 20,000 or less, preferably 10,000 or less.

Because of its excellent properties, a combination of dihydroxybenzene and 1-phenyl-3-pyrazolidone may be most preferably used as a black-and-white developer in the development step of the present invention. A p-aminophenol developing agent can also be used.

Examples of dihydroxybenzene developing agents to be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Particularly preferred among these compounds is hydroquinone.

Examples of p-aminophenol developing agents to be used in the present invention include N-methyl-p-aminophenol, p-aminophenol, N-(8-hydroxyethyl)-p-amino-phenol, N-(4-hydroxyphenyl)glycin, 2-methyl-p-amino-phenol, and p-benzylaminophenol. Particularly preferred among these compounds is N-methyl-p-aminophenol.

Examples of 3-pyrazolidone developing agents to be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

In general, the developing agent is preferably used in an amount of 0.01 to 1.2 mol/l.

Examples of sulfites to be used as preservative in development include sodium sulfite, potassium sulfite, lithium sulfite, ammonium sulfite, sodium bisulfite, and potassium metabisulfite. Such sulfites may be preferably used in an amount of 0.2 mol/l or more, particularly 0.4 mol/l or more. The upper limit of the amount of sulfite to be used is preferably 2.5 mol/l.

The pH of the developer to be used in the development is preferably in the range of 9 to 13, more preferably 10 to 12.

Examples of alkaline agents to be used for the adjustment of pH include pH adjusters such as sodium hydroxide, potassium hydroxide, sodium carbonate, potassium carbonate, sodium tertiary phosphate and potassium tertiary phosphate.

The developer may also contain a buffer such as a borate as described in JP-A-62-186259, saccharose, acetoxime or 5-sulfosalicylic acid as described in JP-A-60-93433, a phosphate, or a carbonate.

The developer may further contain a dialdehyde film hardener or a bisulfite adduct thereof. Specific examples of such a compound include glutaraldehyde and busulfite adducts thereof.

Examples of additives which can be used besides the above-mentioned components include development inhibitors (e.g., sodium bromide, potassium bromide, potassium iodide), organic solvents (e.g., ethylene glycol, diethylene glycol, triethylene glycol, dimethylformamide, methyl cellosolve, hexylene glycol, ethanol, methanol), and antifoggants such as mercapto compounds (e.g., 1-phenyl-5-mercaptotetrazole, sodium 2-mercaptobenzimidazole-5-sulfonate), indazole compounds (e.g., 5-nitroindazole), and benztriazole compounds (e.g., 5-methylbenztriazole). If necessary, the developer may further contain a toner, a surface active agent, a defoaming agent, a water hardener, or an amino compound as described in JP-A-56-106244.

In the development process used in the present invention, the developer may contain a silver stain inhibitor such as a compound as described in JP-A-56-24347.

The developer used in the present invention may also contain an amino compound such as an alkanolamine as described in JP-A-56-106244.

Furthermore, the developer may contain compounds as described in L. F. A. Mason, *Photographic Processing Chemistry*, Focal Press, 1966, pp. 226–229, U.S. Pat. Nos. 2,193,015, and 2,592,364, and JP-A-48-64933.

The fixing solution to be used in the present invention is an aqueous solution containing a thiosulfate and having a pH value of 3.8 or more, preferably 4.2 to 7.0, more preferably 4.5 to 5.5.

As a fixing agent, sodium thiosulfate, ammonium thiosulfate, or the like can be used. Particularly preferred among these fixing agents is ammonium thiosulfate, in view of the fixing rate. The amount of the fixing agent to be used can be altered suitably. It is normally in the range of about 0.1 mol/l to about 6 mol/l.

The fixing solution may contain a water-soluble aluminum salt which acts as film hardener. Examples of such a water-soluble aluminum salt include aluminum chloride, aluminum sulfate, and potassium alum.

The fixing solution may contain tartaric acid, citric acid, gluconic acid or derivatives thereof, singly or in combination. Such a compound is effective when used in an amount of 0.005 mol, particularly 0.01 to 0.03 mol, per l of fixing solution.

The fixing solution may optionally contain a preservative such as sulfite or bisulfite, a pH buffer such as acetic acid or boric acid, a pH adjustor such as sulfuric acid, a chelating agent capable of softening water, or compound as described in JP-A-62-78551.

In the ultrahigh speed processing of the present invention, the percent swelling of the photographic material is reduced (preferably to 100% to 200%) so that the effect of film hardening can be reduced. In particular, the effect of film hardening during development may be preferably made difficult so that the effect of film hardening during fixing can also be made difficult. To this end, the degree of swelling of the light-sensitive material may be reduced. The pH value of the fixing solution may be adjusted to 4.6 or more so that the film hardening reaction can be minimized. Alternatively, the fixing solution may be free of film hardener. The term "percent swelling" used herein means the ratio (in percent) of a total thickness of photographic layers of the photographic material after immersing in water at 21° C. for one minute to that of the photographic material before immersing.

In the development process used in the present invention, the silver halide photographic material which has been developed and fixed can then the processed with a rinsing solution or stabilizing solution at a replenishment rate of 3 or less (including no replenishment, i.e., reservoir rinse) per $m^2$ of the photographic material.

In other words, the process used in the present invention not only enables water-saving processing but also eliminates the need for piping in the automatic developing machine.

As means for reducing the replenishment rate a multistage countercurrent process (e.g., two or three stages) has been used. The multi-stage countercurrent process can be applied to the present invention to effect washing at a higher efficiency because the photographic material which has been fixed is sequentially processed while being brought into contact with the processing solution towards the highest purity, i.e., no contamination with the fixing solution.

In the above mentioned water-saving processing or pipeless processing, the rinsing solution or stabilizing solution may be preferably subjected to anti-mold treatment.

Examples of anti-mold treatments which can be used in the present invention include an ultravioletlight irradiation process as described in JP-A-60-263939, a method utilizing a magnetic field as described in JP-A-60-263940, a method which comprises the use of an ion exchange resin to purify water as described in JP-A-61-131632, and a method utilizing a germicide as described in JP-A-62-115154, JP-A-62-153952 and JP-A-62-209532.

Furthermore, in combination with these additives, germicides, anti-mold agents, and surface active agents as described in L. E. West, "Water Quality Criteria", *Photo. Sci. & Eng.*, Vol. 9, No. 6 (1965), M. W. Beach, "Microbiological Growth in Motion-Picture Processing", SMPTE Journal, Vol. 85 (1976), R.O. Deegan, "Photo Processing Wash Water Biocides", *J. Imaging Tech,* Vol. 10, No. 6 (1984), and JP-A-57-8542, JP-A-57-58143, JP-A-58-105145, JP-A-57-132146, JP-A-58-18631, JP-A-57-97530, and JP-A-57-157244 can be used.

The rinse bath or stabilizing bath may further contain as a microbiocide an isothiazoline compound as described in R. T. Kreiman, *J. Image.* Tech, Vol. 10, No. 6, p. 242 (1984), and *Research Disclosure* Nos. 20526, (May, 1981) and 22845 (Apr., 1983), or a compound as described in JP-A-62-209532.

The rinse bath or stabilizing bath may further contain a compound as described in Hiroshi Horiguchi, *Bokin Bobai no Kaqaku,* Sankyo Shuppan, 1972, and Nihon Bokin Bobai Gakkai, *Bokin Bobai Gijutu Handbook,* Hakuhodo, 1986.

In the present invention, if a small amount of a rinsing solution is used at the rinse step, a squeeze roller rinse bath as described in JP-A-62-32460 may be preferably provided.

The overflow solution from the rinse bath or stabilizing bath produced by replenishing these baths with water which has been subjected to anti-mold treatment may be partially or entirely used as a processing solution having a fixing capacity at the previous step as described in JP-A-60-235133.

The silver halide photographic material of the present invention is characterized in that when it is processed by an automatic developing machine which performs at least development, fixing, rinsing (or stabilizing) and drying, the conventional rapid processing is completed within 90 seconds from development to drying, while the ultrahigh speed processing is completed within 60 seconds from development to drying, i.e., between the point at which the tip of the photographic material begins to be dipped in the developer and the point at which the tip of the photographic material comes out from the drying zone after passing through the fixing, rinsing (or stabilizing) and drying steps (the so-called "dry-to-dry time").

Thus, unprecedentedly high speed processing can be effectively accomplished without adversely affecting other properties (picture quality) by using the photographic material of the present invention.

In the present invention, the term "development time" as used herein means the time between the point at which the tip of the photographic material to be processed is dipped in the developing tank solution and the point at which it is dipped in the following fixing solution in the automatic developing machine. The term "fixing time" as used herein means the time between the point at which the tip of the photographic material is dipped in the fixing tank solution and the point at which it is dipped in the following rinse tank solution (stabilizing solution). The term "rinse time" as used herein means the time during which the photographic material is dipped in the rinse tank solution.

The term "drying time" as used herein means the time during which the photographic material is in a drying zone in which it is dried with hot air at a temperature of 35° C. to 100° C., preferably 40° C. to 80° C.

In order to accomplish the ultrahigh speed processing of the present invention within a dry-to-dry time of 60 seconds, the development preferably takes place at a temperature of about 25° C. to about 50° C. for 6 seconds to 20 seconds, more preferably at a temperature of 30° C. to 40° C. for 6 seconds to 15 seconds.

The fixing temperature and time are similar to the developing temperature and time, respectively. Specifically the fixing preferably takes place at a temperature of about 20° C. to about 50° C. for 6 seconds to 20 seconds, more preferably at a temperature of 30° C. to 40° C. for 6 seconds to 15 seconds.

The rinse or stabilization preferably takes place at a temperature of 0° C. to 50° C. for 6 seconds to 20 seconds, more preferably at a temperature of 30° C. to 40° C. for 6 seconds to 15 seconds.

In accordance with the process for the present invention, the photographic light-sensitive material which has been developed, fixed and rinsed (or stabilized) is then squeezed free of wash water, i.e., dried through squeeze rollers. The drying takes place at a temperature of about 40° C. to about 100° C. The drying time can be altered accordingly based on the ambient condition.

The silver halide emulsion of the present invention can be applied to various usages. Examples of such applications include various photographic light-sensitive materials for printing, such as duplicating, reproduction, and offset master materials, special photographic light-sensitive materials such as X-ray photographic, flash photographic, and electron ray photographic materials, and other photographic light-sensitive materials, such as general copying paper, micro copying paper, direct positive type color light-sensitive material, quick stabilized light-sensitive material, diffusion transfer light-sensitive material, color diffusion light-sensitive material, and light-sensitive material suitable for a combined developing and fixing bath.

The present invention will be further described in the following examples, but the present invention should not be construed as being limited thereto. All parts, percents, and ratios are by weight unless otherwise indicated.

EXAMPLE

1. Preparation of silver halide emulsion of the present invention i) Preparation of thioether emulsion

A thioether having the structural formula $HOCH_2CH_2SCH_2CH_2SCH_2CH_2OH$ was added to a reaction vessel containing gelatin and potassium bromide which had been heated to a temperature of 55° C. in a proper amount. An aqueous solution of silver nitrate and an aqueous solution of potassium bromide were then added to the system by a controlled double jet process while the pAg value of the system was kept at 7.6 to form grains. The amount of the thioether added was adjusted accordingly to control the average grain size to 0.42 μm. The grains were cubic and monodisperse such that 98% of all the grains fell within ±40% from the average grain size. The emulsion was then desalted. Gelatin and 30,000 ppm of phenoxy ethanol as preservative were added to the emulsion so that the pH and pAg values thereof were adjusted to 6.8 and 8.9, respectively. Thiourea dioxide and chloroauric acid were added to the emulsion in amounts of 4 mg/mol Ag and 3.2 mg/mol Ag, respectively. The emulsion was then heated to a temperature of 65° C. for 80 minutes to form fogged nuclei. 1,000 g of the starting emulsion contained 111 g of silver and 35 g of gelatin. 2. Preparation of emulsion coating solution 1,000 g of the thus obtained emulsion were weighed out. Gelatin was added to the emulsion in the necessary amount as set forth below. The emulsion was then heated to a temperature of 40° C. so that dissolution was made. To the emulsion were added 50 cc of a 0.8% methanol solution of 5-ethoxycarbonyl-1,3,3-trimethyl-2-[2-(2,4-dimethyl-9-oxopyrazolo[5,1-b]quinazoline-3-yl)vinyl]-3H-indolium-4-methylbenzene sulfonate as a sensitizer, 20 cc of a 50 wt % aqueous solution of trimethylolpropane as a wetting agent, an aqueous solution of 4-hydroxy-6-methyl-1,3,3a,7-tetraazaindene as a stabilizer, an aqueous solution of dedecylbenzenesulfonate as a coating aid, an aqueous solution of polyacrylamide as a binding aid, and an aqueous solution of polypotasium-p-vinylbenzenesulfonate as a thickening agent.

The necessary amount of gelatin added was the value required to give a desired coated amount of gelatin when the coated amount of silver in the emulsion layer of the coated product was 2.6 g/m$^2$. The necessary amount of gelatin added to each emulsion coating solution prepared for this Example is set forth below.

| | |
|---|---|
| Emulsion Coating Solution a: | the added amount of gelatin was 0 g |
| Emulsion Coating Solution b: | the added amount of gelatin was 51 g |
| Emulsion Coating Solution c: | the added amount of gelatin was 30 g |
| Emulsion Coating Solution d: | the added amount of gelatin was 64 g |
| Emulsion Coating Solution e: | the added amount of gelatin was 38 g |

3. Preparation of coating solution for protective layer in the light-sensitive material To a 10 wt % aqueous solution of gelatin which had been heated to a temperature of 40° C. were added 10 cc of a 2 wt % aqueous solution of sodium polystyrene sulfonate as a thickening agent, two kinds of finely divided polymethyl methacrylate grains (1 g of grains with an average grain size of 2 μm and 5 g of grains with an average grain size of 0.8 μm) as a matting agent, a 4 wt % aqueous solution of N,N'-ethylenebis(vinylsulfonylacetamide) as a film hardener, an aqueous solution of sodium t-octylphenoxyethoxyethanesulfonate as coating aid, an aqueous solution of polyethylene surface active agent of the following structural formulas (1)-(3) and an aqueous solution of a fluorine-containing compound of the following structural formula (4) as antistatic agents, 50 cc of a 15% aqueous solution of polyacrylamide, polyacrylic acid, and silica. Water was then added to the emulsion to make 15 l. Each of the protective layer coating solutions set forth below were prepared in this manner.

The content of the film hardener was adjusted to 1.5 wt % based on the the total layer amount of gelatin in the protective layer and the emulsion layer so that the water swelling at 20° C. was 150%. Antistatic Agents:

$$C_8H_{17}SO_2N(-C_3H_7)-(CH_2CH_2O)_4-(CH_2)_4SO_3Na \quad (1)$$

$$C_{16}H_{33}O(CH_2CH_2O)_{10}-H \quad (2)$$

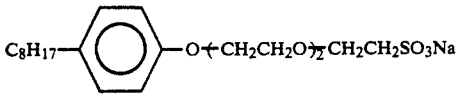

(3)

-continued $$C_8F_{17}SO_3K \quad (4)$$

By altering the amount of the 10 wt % aqueous solution of gelatin added during the preparation of the protective layer coating solution, the coated amount of gelatin in the protective layer in the coated product was altered.

| Protective Layer | |
|---|---|
| Coating Solution i: | made from 1,200 g of the 10 wt % aqueous solution of gelatin |
| Coating Solution ii: | made from 1,500 g of the 10 wt % aqueous solution of gelatin |
| Coating Solution iii: | made from 2,000 g of the 10 wt % aqueous solution of gelatin |
| Coating Solution iv: | made from 2,200 g of the 10 wt % aqueous solution of gelatin |
| Coating Solution v: | made from 2,500 g of the 10 wt % aqueous solution of gelatin |
| Coating Solution vi: | made from 2,700 g of the 10 wt % aqueous solution of gelatin |

4. Preparation of back coating solution

To 1,000 g of a 10 wt % aqueous solution of gelatin which had been heated to a temperature of 40° C. were added an aqueous solution of sodium polyethylene sulfonate as a thickening agent, 400 cc of each of 6% an aqueous solution containing 6% of each of dyes having the following structural formulae (5)-(7), an aqueous solution of N,N'-ethylenebis-(vinylsulfonylacetamide) as a film hardener, an aqueous solution of sodium t-octylphenoxyethoxyethanesulfonate as a coating aid, finely divided polymethyl methacrylate grains (average grain size: 1.2 μm), silica, and an aqueous solution of a copolymer of methyl methacrylate and ethyl acrylate. Thus, a back coating solution as prepared.

Dyes

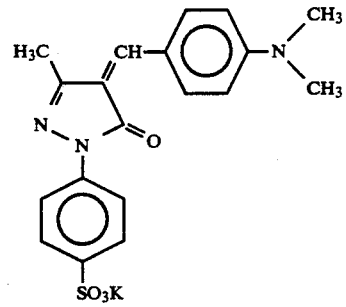

(5)

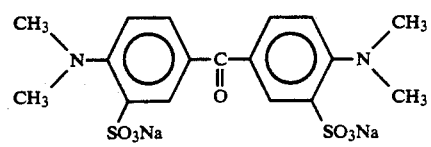

(6)

-continued

Dyes

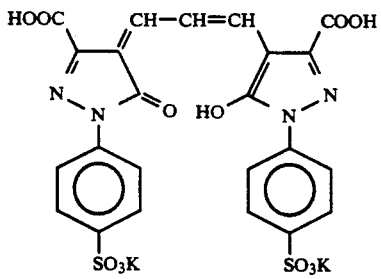

(7)

5. Preparation of coating solution of surface protective layer for back layer

To a 10 wt % aqueous solution of gelatin which had been heated to a temperature of 40° C. were added an aqueous solution of sodium polystyrenesulfonate as thickening agent, finely divided polymethylmethacrylate grains (average grain size: 3.0 μm) as matting agent, an aqueous solution of sodium t-octylphenoxyethoxyethanesulfonate as coating aid, and an aqueous solution of polyethylene surface active agents of the structural formulas (2) and (3) described above and an aqueous solution of a fluorine-containings of the following formulas (8)-(10) as antistatic agents compound to prepare a coating solution. Antistatic Agents:

$$C_8F_{17}SO_2N(C_3H_7)-(CH_2CH_2O)_4-(CH_2)_4SO_3Na \quad (8)$$

$$C_8F_{17}SO_2N(C_3H_7)CH_2COOK \quad (9)$$

$$C_8F_{17}SO_2N(C_3H_7)(CH_2CH_2O)_{15}H \quad (10)$$

6. Preparation of coated specimens

The above mentioned back coating solution and back protective layer coating solution were coated together on one side of a polyethylene terephthalate support in amounts such that the gelatin content of the back layer and the back protective layer reached 2.5 g/m$^2$ and 1 g/m$^2$, respectively, thereby totalling 3.5 g/m$^2$.

The emulsion coating solution as prepared in section 2 and the protective layer coating solution as prepared in section 3 were then added to the other side of support in that order. The coated amount of gelatin in the emulsion layer and the protective layer was according the combinations as set forth below. The coated amount of silver was adjusted to 2.6 g/m$^2$.

| | |
|---|---|
| Coated specimen I: | prepared from Emulsion Coating Solution a and Protective Layer Coating Solution ii, with the coated amounts of gelatin being 1 g/m$^2$ and 1.5 g/m$^2$, resectively, thereby totalling 2.5 g/m$^2$ |
| Coated specimen II: | prepared from Emulsion Coating Solution a and Protective Layer Coating Solution v, with the coated amounts of gelatin being 1 g/m$^2$ and 2.5 g/m$^2$, respectively, thereby totalling 3.5 g/m$^2$ |
| Coated specimen III: | prepared from Emulsion Coating Solution b and Protective Layer Coating Solution ii, with the coated amounts of gelatin being 2.0 g/m$^2$ and 1.5 g/m$^2$, respectively, thereby totalling 3.5 g/m$^2$ |
| Coated specimen IV: | prepared from Emulsion Coating Solution c and Protective Layer Coating Solution iii, with the coated amounts of gelatin being 1.5 g/m$^2$ and 2.0 g/m$^2$, respectively, thereby totalling 3.5 g/m$^2$ |
| Coated specimen a: | prepared from Emulsion Coating Solution a and Protective Layer Coating Solution i, with the coated amounts of gelatin being 1.0 g/m$^2$ and 1.2 g/m$^2$, respectively, thereby totalling 2.2 g/m$^2$ |
| Coated specimen b: | prepared from Emulsion Coating Solution a and Protective Layer Coating Solution vi, with the coated amounts of gelatin being 0.8 g/m$^2$ and 2.7 g/m$^2$, respectively, thereby totalling 3.5 g/m$^2$ |
| Coated specimen c: | prepared from Emulsion Coating Solution d and Protective Layer Coating Solution ii, with the coated amounts of gelatin being 2.3 g/m$^2$ and 1.5 g/m$^2$, respectively, thereby totalling 3.8 g/m$^2$ |
| Coated specimen d: | prepared from Emulsion Coating Solution e and Protective Layer Coating Solution iv, with the coated amounts of gelatin being 1.7 g/m$^2$ and 2.2 g/m$^2$, respectively, thereby totalling 3.9 g/m$^2$ |
| Coated specimen e: | prepared from Emulsion Coating Solution d and Protective Layer Coating Solution i, with the coated amounts of gelatin being 2.3 g/m$^2$ and 1.2 g/m$^2$, respectively, thereby totalling 3.5 g/m$^2$ |

These coated specimens were stored at a temperature of 20° C. and a relative humidity of 65% for 7 days, and then evaluated for the following properties.

7. Evaluation of dryability

The coated specimens were uniformly exposed to light from a BLB light source (emitting light having a peak at a wavelength of 365 nm) at room temperature for 15 seconds in a duplicator available from Du Pont. These specimens were then subjected to 45-second speed processing with a developer RD-7 (a product of Fuji Photo Film Co., Ltd.) and a fixing solution Fuji F (a product of Fuji Photo Film Co., Ltd.) at a temperature of 35° C. in an automatic developing machine (manufactured by Fuji Photo Film Co., Ltd.). 30 sheets (35.6 cm×43.2 cm) of these specimens were continuously processed to reach the steady state of processings. If the 30th sheet was dry, the specimen was considered to pass the dryability test (P). On the other hand, if the 30th sheet was not yet dry, the specimen was considered to fail the test (F).

8. Evaluation of roller marking

The coated specimens were uniformly exposed to light from a BLB light source in a duplicator available from Du Pont at room temperature in such a manner that the optical density after processing was about 1.0. The specimens were then processed with Developer RD-7 and Fixing Solution Fuji F in the automatic developing machine FPM-9000 at a temperature of 35° C. Each specimen was then examined for roller marks. If roller marks were discovered, the specimen was considered to fail the test (F). On the other hand, if no roller marks were discovered, the specimen was considered to pass the test (P).

9. Evaluation of scratch pinholing

Film specimens (35.6 cm×43.2 cm) which had not been exposed were processed with Developer RD-7 and Fixing Solution Fuji F in the automatic developing machine FPM-9000 at a temperature of 35° C. These film specimens were mounted on a ground glass plate under which lamps were placed. The system was screened from external light. The room lamp was then turned off. The pinholes were then counted. If 50 or more pinholes were counted, the specimen was considered to fail the test (F). On the other hand, if less than 50 pinholes were counted, the specimen was considered to pass the test (P).

10. Results

The results from the evaluations are set forth below in Table 1.

Only the specimens of the present invention passed all of the tests.

TABLE 1

| Coat Specimen | Coated amount of gelatin ($g/m^2$) | | | Judgement of properties | | | Overall judgement |
|---|---|---|---|---|---|---|---|
| | Emulsion layer | Protective layer | Total | Dryability | Roller mark | Scratch pinhole | |
| I | 1.0 | 1.5 | 2.5 | P | P | P | P |
| II | 1.0 | 2.5 | 3.5 | P | P | P | P |
| III | 2.0 | 1.5 | 3.5 | P | P | P | P |
| IV | 1.5 | 2.0 | 3.5 | P | P | P | P |

TABLE 1-continued

| Coat Specimen | Coated amount of gelatin ($g/m^2$) | | | Judgement of properties | | | Overall judgement |
|---|---|---|---|---|---|---|---|
| | Emulsion layer | Protective layer | Total | Dryability | Roller mark | Scratch pinhole | |
| a | 1.0 | 1.2 | 2.2 | P | P | F | F |
| b | 0.8 | 2.7 | 3.5 | P | F | P | F |
| c | 2.3 | 1.5 | 3.8 | F | P | P | F |
| d | 1.7 | 2.2 | 3.9 | F | P | P | F |
| e | 2.3 | 1.2 | 3.5 | P | P | F | F |

(Note: Specimens I, II, III, and IV were in accordance with the present invention, while the other specimens were comparative)

While the invention has been described in detail and with reference to specific embodiments thereof, it will be apparent to one skilled in the art that various changes and modifications can be made therein without departing from the spirit and scope thereof.

What is claimed is:

1. A silver halide photographic material element comprising a support having thereon, in sequence, a hydrophilic silver halide emulsion layer and a protective layer, wherein gelatin is contained in said protective layer in an amount of at least 1.5 $g/m^2$, gelatin is contained in said emulsion layer in an amount of at least 1.0 $g/m^2$, and the coated amount of gelatin in said protective layer and said emulsion layer is a total of at most 3.5 $g/m^2$.

2. A silver halide photographic material element as in claim 1, wherein said gelatin is inert gelatin.

3. A silver halide photographic material element as in claim 1, wherein at least one of dextran and polyacrylamide is present together with gelatin in said emulsion layer.

4. A silver halide photographic material element as in claim 1, wherein said support is colored blue.

* * * * *